US006602600B2

(12) United States Patent
Zhu

(10) Patent No.: US 6,602,600 B2
(45) Date of Patent: Aug. 5, 2003

(54) YARN AND FABRIC HAVING IMPROVED ABRASION RESISTANCE

(75) Inventor: Reiyao Zhu, Midlothian, VA (US)

(73) Assignee: E. I. du Pont de Nemours and Company, Wilmington, DE (US)

( * ) Notice: Subject to any disclaimer, the term of this patent is extended or adjusted under 35 U.S.C. 154(b) by 151 days.

(21) Appl. No.: 09/747,675

(22) Filed: Dec. 22, 2000

(65) Prior Publication Data

US 2002/0123284 A1 Sep. 5, 2002

(51) Int. Cl.[7] ..... D01F 6/00

(52) U.S. Cl. ..... 428/364; 428/362; 428/365; 428/395

(58) Field of Search ..... 428/364, 362, 428/365, 373, 395

(56) References Cited

U.S. PATENT DOCUMENTS

| | | | | |
|---|---|---|---|---|
| 4,143,197 A | | 3/1979 | Jasionowicz et al. | |
| 4,299,884 A | | 11/1981 | Payen | |
| 4,539,249 A | | 9/1985 | Curzio | |
| 4,686,132 A | | 8/1987 | Sumii et al. | |
| 4,900,613 A | * | 2/1990 | Green | 428/225 |
| 4,920,000 A | | 4/1990 | Green | |
| 5,102,604 A | | 4/1992 | Sidles et al. | |
| 5,293,676 A | | 3/1994 | Geirhos et al. | |
| 5,424,123 A | | 6/1995 | Geirhos et al. | |
| 5,822,791 A | | 10/1998 | Baris | |
| 6,021,523 A | | 2/2000 | Vero | |
| 6,254,988 B1 | * | 7/2001 | Zhu et al. | 428/373 |

FOREIGN PATENT DOCUMENTS

| | | |
|---|---|---|
| DE | 40 09 611 | 10/1991 |

* cited by examiner

*Primary Examiner*—N. Edwards

(57) ABSTRACT

The present invention relates to a yarn having improved abrasion resistance and a fabric made from that yarn, as well as process for preparing the yarn and fabric. The yarn includes (a) aramid fibers and (b) up to 40 weight percent of fibers of synthetic polymers having a melting point between 200 and 300 degrees C., based upon the total weight of (a) and (b) only, the yarn or fabric including the yarn being heat treated at a temperature below the melting point of the fibers of component (b).

12 Claims, No Drawings

YARN AND FABRIC HAVING IMPROVED ABRASION RESISTANCE

BACKGROUND OF THE INVENTION

1. Field of the Invention

This invention relates to the field of yarns and fabrics that that are abrasion resistant, and in particular it relates to the field of yarns and fabrics that include abrasion-resistant or cut-resistant fibers.

2. Description of Related Art

Protective apparel such as gloves that include abrasion-resistant or cut-resistant yarn are known in the art. For example, U.S. Pat. No. 5,822,791, discloses a protective glove that is resistant to cuts and to the penetration of liquid. The glove is made from a cut-resistant yarn, such as yarn made from aramid fibers, an intermediate layer that of a natural fiber, and an outer layer of a flexible, elastomeric material impervious to liquid.

U.S. Pat. No. 6,021,523 discloses a hand covering that is heat and abrasion resistant which is made by using a fabric formed from aramid fiber that is wound with a top cover of a yarn of oxidized polyacrylonitrile or polyacrylate. The aramid fiber is conditioned with steam and then with an ignition resistant wax or an organosilicone compound.

Cut-resistant and abrasion-resistant gloves are typically used in applications that subject the gloves to repeated exposure to sharp objects. As a result of this exposure, the gloves have a limited wear life and need to be replaced often.

As shown in U.S. Pat. No. 4,920,000, there have been attempts to improve the abrasion resistance of gloves by blending aramid fibers with other high abrasion-resistant fibers such as nylon. The improvement in abrasion resistance of articles made by such blends of aramid and nylon fibers is proportional to the amount of nylon fibers in the blend, but the improvement in such articles is still limited.

Accordingly, there is a need in the art to provide a yarns and fabrics that have improved cut resistance and abrasion resistance so as to extend the wear-life of articles such as gloves that are made from those yarns and fabrics.

SUMMARY OF THE INVENTION

The present invention relates to a yarn having improved abrasion resistance, a fabric that includes that yarn, and a process for preparing the yarn or fabric. The yarn includes (a) aramid fibers and (b) up to 40 weight percent of fibers of synthetic polymers having a melting point between 200 and 300 degrees C., based upon the total weight of (a) and (b) only, the yarn having been heat treated at a temperature below the melting point of the fibers of component (b). The heat treatment of the yarn may take place before or after the yarn is made into a fabric.

DETAILED DESCRIPTION OF THE INVENTION

The present invention is directed to a yarn, and fabrics which include that yarn, that have an increased resistance to abrasion compared to conventional abrasion resistant yarns and fabrics, and yet are not undesirably stiff.

The yarns of the invention include (a) aramid fibers and (b) up to 40 weight percent of fibers of synthetic polymers having a melting point between 200 and 300 degrees C. An important aspect of the invention is that the yarns, or fabric that includes the yarns, are heat treated at a temperature below the melting point of the fibers of component (b).

The aramid fibers used in component (a) of the yarns or fabric of this invention are para-aramid fibers. By para-aramid fibers is meant fibers made from para-aramid polymers or fibers made from what are known as rigid rod polymers. A preferred polymer is poly(p-phenylene terephthalamide)(PPD-T). By PPD-T is meant the homopolymer resulting from mole-for-mole polymerization of p-phenylene diamine and terephthaloyl chloride and, also, copolymers resulting from incorporation of small amounts of other diamines with the p-phenylene diamine and of small amounts of other diacid chlorides with the terephthaloyl chloride. As a general rule, other diamines and other diacid chlorides can be used in amounts up to as much as about 10 mole percent of the p-phenylene diamine or the terephthaloyl chloride, or slightly higher, provided that the other diamines and diacid chlorides have no reactive groups which interfere with the polymerization reaction. The term PPD-T also includes copolymers resulting from incorporation of other aromatic diamines and other aromatic diacid chlorides such as, for example, 2,6-naphthaloyl chloride or chloro- or dichloroterephthaloyl chloride; provided only that the other aromatic diamines and aromatic diacid chlorides be present in amounts which do not adversely affect the properties of the para-aramid.

Additives can be used with the para-aramid in the fibers and it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid.

P-aramid fibers may be made by processes well known in the art, and are generally spun by extrusion of a solution of the p-aramid through a capillary into a coagulating bath. In the case of poly(p-phenylene terephthalamide), the solvent for the solution is generally concentrated sulfuric acid and the extrusion is generally through an air gap into a cold, aqueous, coagulating bath.

The fibers of component (b) of the invention may be fibers of nylon, polyester, or blends thereof.

As used herein, the term "nylon" means aliphatic polyamide polymers including with polyhexamethylene adipamide (nylon 66), polycaprolactam (nylon 6), polybutyrolactam (nylon 4), poly(9-aminononanoic acid) (nylon 9), polyenantholactam (nylon 7), polycapryllactam (nylon 8), polyhexamethylene sebacamide (nylon 6, 10), and the like. Polyhexamethylene adipamide (nylon 66) is a preferred nylon.

"Nylon fibers" means any fibers made from nylon. Nylon fibers are generally spun by extrusion of a melt of the nylon polymer through a capillary into a gaseous congealing medium and other processes known in the art.

As used herein the term "polyester" means polymers synthesized from the polycondensation of a diol and a dicarboxylic acid.

"Polyester fibers" means any fibers made from polyester. Polyester fibers are spun from molten polymer by the melt spinning process and other processes known in the art.

The yarn of the invention may include up to about 40 weight percent of the fibers of component (b). A higher amount of the fibers of component (b) may be used but no increase in the abrasion resistance of the yarn or fabric made using the yarn is observed in doing so. A preferred range of fibers in the yarn is from about 70 to about 95 weight percent of fibers of component (a) and from about 5 to about 30 weight percent of fibers of component (b), and a more preferred range is from about 75 to about 90 weight percent of fibers of component (a) and from about 10 to about 25 weight percent of fibers of component (b). These weight percents are based upon the relative amounts of components (a) and (b) only.

The fibers of components (a) and (b) are preferably staple fibers of a particular length and of a particular linear density. For use in this invention, synthetic fiber staple lengths of 2.5 to 15 centimeters (1 to 6 inches) may be used, with lengths of 3.8 to 11.4 centimeters (1.5 to 4.5 inches) being preferred. The linear density of the fibers may be from 0.5 to 7 decitex, preferably from 1 to 3 decitex.

The fibers can be spun into yarns using any conventional means, such as ring spinning, air-jet spinning, Murata-jet spinning, or friction spinning. The yarns, once spun, may be twisted together to make plied yarns.

An important aspect of the present invention is that the yarn or fabric is heat treated. This heat treatment may be conducted on yarn which is then made into a woven or knitted fabric. This fabric exhibits an increase in abrasion resistance compared to fabric in which the yarn is not heat treated. Alternatively, the yarn which has not been heat treated may be made into a woven or knitted fabric and then that fabric is heat treated. This fabric also exhibits an increase in abrasion resistance compared to fabric in which the yarn is not heat treated.

The woven or knitted fabric may include 100 weight percent of the yarns of the invention. Preferably the fabric includes no less that 10 weight percent of the yarns of the invention, more preferably no less than 40 weight percent of the yarns of the invention.

The yarn or fabric should be heat treated at a temperature below the melting point of component (b). In general, the yarn or fabric should be heat treated at a temperature of from about 100 to about 300 degrees C. for a time of from about 10 to about 20 minutes. A preferred temperature is from 150 to 300 degrees C., and a more preferred temperature is from about 200 to about 250 degrees C. Stated another way, the yarn or fabric may be heat treated at a temperature less than about 90 percent of the melting point of component (b). A preferred heating time is from about 5 to about 10 minutes. The heating is typically carried out at atmospheric pressure.

Temperatures above 300 degrees C. may be used but such higher temperatures are not practical since above that temperature polyester melts and the heat-treated yarn or fabric becomes undesirably stiff.

Similarly, heating times of greater than 20 minutes may be used, but such greater heating times are not practical since such longer heating times can result in the yarn or fabric becoming undesirably stiff.

The yarn and fabric of the invention may be used in any article that is exposed to abrasion and where a high resistance to abrasion is desired. Examples of such articles include chaps, protective apparel, aprons, sleeves, hand coverings such as gloves, and the like.

EXAMPLES

The abrasion resistance of various fabrics was tested in the following examples using the test method titled "Standard Method for Abrasion Resistance of Textile Fabrics", ASTM Standard D3884-92. In this test, a sample fabric is abraded using rotary rubbing under controlled conditions of pressure and abrasive action. In particular, a Taber Abraser and a #H-18 abrasive wheel was used to abrade fabric samples under a load of 500 grams. The abrasion was continued until the abrasive wheel reached the point where it rubbed through of the fabric sample. The number of revolutions to reach the point of rub-through was determined for four samples and the average is reported.

Example 1 and Comparative Example 2

These Examples compare the effect of heat treatment on certain fabrics. A high abrasion resistant fabric of present invention was prepared from ring-spun yarns of intimate blends of PPD-T staple fibers and polyester fibers. The PPD-T fibers were 1.5 dpf and 1.5 inches long, and polyester fibers were 1.2 dpf and 1.5 inches long. A picker blend sliver of 90 weight percent PPD-T and 10 weight percent polyester was prepared and processed by the conventional cotton system into spun yarn having 3.2 twist multiplier using a ring spinning frame. The yarn so made was 10 cc (cotton count). Two of these single yarns were then plied together with reverse twist to form a balanced yarn of 10/2 cc.

The 10/2 cc yarns were knitted into samples of gloves using a standard Sheima Seiki glove knitting machine. The machine knitting time was adjusted to produce glove bodies about one meter long to provide fabric samples for subsequent cut and abrasion testing. The samples were made by feeding 3 ends of the 10/2 cc yarn to the glove knitting machine to yield fabric samples of about 20 oz/sq. yd (0.67 kg/sq. meter). The fabric was then heat treated in oven at 250C for 10 minutes.

For comparative purposes, there was used a sample of the same fabric that was not heat treated.

The heat treated fabric and the non heat-treated fabric were both subjected to the aforementioned ASTM abrasion resistance test and the results are listed in Table 1 below.

TABLE 1

| Example No. | Abrasion Resistance (cycles) |
|---|---|
| Ex. 1 | 2049 |
| C. Ex. 2 | 971 |

These Examples show the unexpected increase in the abrasion resistance of the fabrics of the invention.

Comparative Example 3 and Examples 4–6

These Examples show the effect of the heating temperature on the abrasion resistance of fabrics. The fabric made in Example 1, before heat treating, was heat treated at 3 different temperatures for the same amount of time, 10 minutes. The abrasion resistance of the heat treated fabrics was measured as in Example 1, and the results are listed in Table 2 below.

TABLE 2

| Example No. | Temp. (C.) | Abrasion Resistance (cycles) |
|---|---|---|
| C. Ex. 3 | no heat treatment | 971 |
| Ex. 4 | 100 | 1265 |
| Ex. 5 | 200 | 1653 |
| Ex. 6 | 250 | 2049 |

These Examples show the unexpected improvement in abrasion resistance in the fabric that is heat treated in accordance with the present invention.

Comparative Example 7 and Examples 8–12

These Examples show the effect of effect of heating time on the abrasion resistance of a fabric. The fabric made in Example 1, before heat treating, was heat treated at 250 degrees C. for 5 different time periods. The abrasion resistance of the heat treated fabrics was measured as in Example 1, and the results are listed in Table 3 below.

TABLE 3

| Example No. | Time (min.) | Abrasion Resistance (cycles) |
|---|---|---|
| C. Ex. 7 | 0 | 900 |
| Ex. 8 | 5 | 1600 |
| Ex. 9 | 10 | 1800 |
| Ex. 10 | 15 | 2000 |
| Ex. 11 | 20 | 2300 |
| Ex. 12 | 30 | 1700 |

These Examples show the unexpected improvement in abrasion resistance in the fabric that is heat treated in accordance with the present invention. The data show that when the fabric was heat treated for 30 minutes at 250C, the abrasion resistance was higher than the comparative Example which had not been heat treated but had decreased compared to the fabric of Example 11 that had been heat treated for 20 minutes.

Comparative Example 13 and Examples 14–17

These Examples show the effect of the amount of component (b) on the abrasion resistance of a fabric. A high abrasion resistant fabric was prepared from ring-spun yarns of intimate blends of PPD-T staple fibers and nylon fibers. The PPD-T fibers were 1.5 dpf and 1.5 inches long, and the nylon fibers were 1.1 dpf and 1.5 inches long.

A picker blend sliver of PPD-T and nylon was prepared with 4 different blends of PPD-T and nylon and processed by the conventional cotton system into spun yarns having 3.2 twist multiplier using a ring spinning frame. The yarns so made were 10 cc (cotton count). Two of these single yarns were then plied together with reverse twist to form a balanced yarn 10/2 cc.

The fabric samples were made as in Example 1. For comparison purposes a fabric was also made in the same way except that the fabric was made from 100% of the PPD-T fibers The fabric samples were then heat treated at 250C for 10 minutes. The abrasion resistance of the heat-treated and non heat-treated fabrics are listed in Table 4 below.

TABLE 4

| Example | | | Abrasion resistance (cycles) | |
|---|---|---|---|---|
| No. | PPD-T (%) | Nylon (%) | Untreated | Treated |
| C. Ex. 13 | 100 | 0 | 860 | 1395 |
| Ex. 14 | 90 | 10 | 1000 | 1850 |
| Ex. 15 | 80 | 20 | 1219 | 2960 |

TABLE 4-continued

| Example | | | Abrasion resistance (cycles) | |
|---|---|---|---|---|
| No. | PPD-T (%) | Nylon (%) | Untreated | Treated |
| Ex. 16 | 70 | 30 | 1173 | 2122 |
| Ex. 17 | 60 | 40 | 1355 | 1676 |

These Examples demonstrated the unexpected increase in abrasion resistance when the fabrics of Examples 14–17 were heat treated. Further, the Examples 14–17 demonstrated an unexpected increase in abrasion resistance of fabrics made with yarns that were blends of PPD-T and nylon compared to fabrics made from yarns of PPD-T alone.

What is claimed is:

1. A yarn having improved abrasion resistance comprising (a) aramid fibers and (b) up to 40 weight percent of fibers of synthetic polymers having a melting point between 200 and 300 degrees C., based on the relative amounts of components (a) and (b) only, said yarn having been heat treated at a temperature below the melting point of the fibers of component (b) with the provisos (i) synthetic polymer fibers are present and (ii) the heat treating is at a temperature of at least 100 degrees C.

2. The yarn of claim 1, wherein the fibers of component (a) are fibers of para-aramid.

3. The yarn of claim 1, wherein the fibers of component (a) are fibers of p-phenylene terephthalamide.

4. The yarn of claim 1, wherein the fibers of component (b) are fibers of nylon, polyester, or blends thereof.

5. The yarn of claim 1, wherein the fibers of component (b) are present in an amount of from 5 to 30 weight percent based upon the total weight of the fibers of components (a) and (b) only.

6. The yarn of claim 1, wherein the fibers of component (b) are present in an amount of from 10 to 25 weight percent based upon the total weight of the fibers of components (a) and (b) only.

7. The yarn of claim 1, wherein the fibers are staple fibers having lengths from 2.5 to 15 centimeters.

8. The yarn of claim 1, wherein the fibers of component (b) are fibers of nylon and the yarn is heat treated at a temperature up to about 250 degrees C.

9. The yarn of claim 1, wherein the fibers of component (b) are fibers of polyester and the yarn is heat treated at a temperature up to about 250 degrees C.

10. The yarn of claim 1, wherein the yarn is heat treated for an amount of time up to about 20 minutes.

11. An article made from the yarn of claim 1.

12. The yarn of claim 1 wherein the heat treated temperature is in a range from 200 to 250 degrees C.

* * * * *